US007240737B2

(12) United States Patent
Tips

(10) Patent No.: US 7,240,737 B2
(45) Date of Patent: Jul. 10, 2007

(54) DIRECT PROPORTIONAL SURFACE CONTROL SYSTEM FOR DOWNHOLE CHOKE

(75) Inventor: Timothy R. Tips, Spring, TX (US)

(73) Assignee: WellDynamics, Inc., Spring, TX (US)

( * ) Notice: Subject to any disclaimer, the term of this patent is extended or adjusted under 35 U.S.C. 154(b) by 0 days.

(21) Appl. No.: 11/403,039

(22) Filed: Apr. 11, 2006

(65) Prior Publication Data

US 2006/0237196 A1 Oct. 26, 2006

(51) Int. Cl.
*E21B 34/10* (2006.01)
*E21B 34/16* (2006.01)

(52) U.S. Cl. ..... 166/373; 166/375; 166/319; 166/66.6

(58) Field of Classification Search ..... 166/373–375, 166/319, 66.6, 66.7; 251/11
See application file for complete search history.

(56) References Cited

U.S. PATENT DOCUMENTS 3,254,531 A * 6/1966 Briggs, Jr. ..... 73/152.24
3,289,474 A * 12/1966 Smith ..... 73/152.41
3,294,170 A * 12/1966 Warren et al. ..... 166/100
4,375,239 A 3/1983 Barrington et al.
4,880,060 A 11/1989 Schwendemann et al.
5,238,070 A 8/1993 Schultz et al.
5,251,703 A 10/1993 Skinner
5,273,112 A 12/1993 Schultz
5,355,960 A 10/1994 Schultz et al.
5,547,029 A 8/1996 Rubbo et al.
5,957,195 A * 9/1999 Bailey et al. ..... 166/55
6,095,249 A * 8/2000 McGarian et al. ..... 166/319
6,179,052 B1 1/2001 Purkis et al.
6,543,544 B2 4/2003 Schultz et al.
6,585,051 B2 7/2003 Purkis et al.
6,695,061 B2 2/2004 Fripp et al.
6,736,213 B2 5/2004 Bussear et al.

OTHER PUBLICATIONS

Search Report for PCT/US05/13220.

* cited by examiner

*Primary Examiner*—David Bagnell
*Assistant Examiner*—Shane Bomar
(74) *Attorney, Agent, or Firm*—Smith IP Services, P.C.

(57) ABSTRACT

A direct proportional control system for remotely controlling actuation of a tool. A well control system includes an actuator for a downhole well tool, the actuator including an actuator member which displaces to operate the well tool. A control system member is positioned at a remote location. A displacement of the control system member is proportional to a displacement of the actuator member.

24 Claims, 4 Drawing Sheets

DIRECT PROPORTIONAL SURFACE CONTROL SYSTEM FOR DOWNHOLE CHOKE

CROSS-REFERENCE TO RELATED APPLICATION

The present application claims the benefit under 35 USC §119 of the filing date of International Application No. PCT/US2005/013220, filed on Apr. 20, 2005, the entire disclosure of which is incorporated herein by this reference.

BACKGROUND

The present invention relates generally to operations performed and equipment utilized in conjunction with a subterranean well and, in an embodiment described herein, more particularly provides a direct proportional surface control system for a downhole choke.

Many control systems are available for controlling actuation of downhole well tools. Unfortunately, these existing control systems are typically very complex and, therefore, expensive and susceptible to failure in a hostile, corrosive, high temperature and debris-laden well environment.

Furthermore, most existing control systems leave an operator at the surface unsure of the actual position of a downhole actuator. The operator may be provided with an indication of where the downhole actuator should be based on pressure levels, number of pressure applications, etc., but no direct physical indicator is provided to the operator of the actuator's actual position.

In typical open-loop hydraulic control systems, hydraulic fluid is delivered to one side of a piston by a pump, and fluid is discharged from the other side of the piston to a reservoir, usually at atmospheric pressure. One disadvantage of such open-loop hydraulic control systems is that gas entrained in the fluid at low pressures (e.g., at atmospheric pressure) causes non-linear changes in volume as the pressure is increased (e.g., by use of a pump). Such non-linear changes in fluid volume produce uncertainty in the resultant displacement of the piston.

Therefore, it may be seen that improvements are needed in systems for controlling operation of remotely located tools. It is an object of the present invention to provide such improvements.

SUMMARY

In carrying out the principles of the present invention, a control system is provided which solves at least one problem in the art. One example is described below in which a piston of the control system at a remote location displaces in order to displace a piston of an actuator for a tool. The displacements of the pistons are proportional to each other, so that by receiving an indication of the remote control system piston displacement, the actuator piston displacement may be known.

In one aspect of the invention, a system for controlling operation of a tool is provided. The system includes an actuator for the tool, the actuator including an actuator member which displaces to operate the tool. A control system member is disposed at a location remote from the actuator. A displacement of the control system member causes a displacement of the actuator member, the control system member displacement being proportional to the actuator member displacement.

In another aspect of the invention, a well control system includes an actuator for a downhole well tool, the actuator including an actuator member which displaces to operate the well tool. A control system member is visible to an operator of the control system at a surface location. A displacement of the control system member is proportional to a displacement of the actuator member.

In yet another aspect of the invention, a method of controlling actuation of a tool includes the steps of: displacing a control system member; and displacing an actuator member of an actuator for the tool in response to the control system member displacing step, a displacement of the actuator member being proportional to a displacement of the control system member.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1:
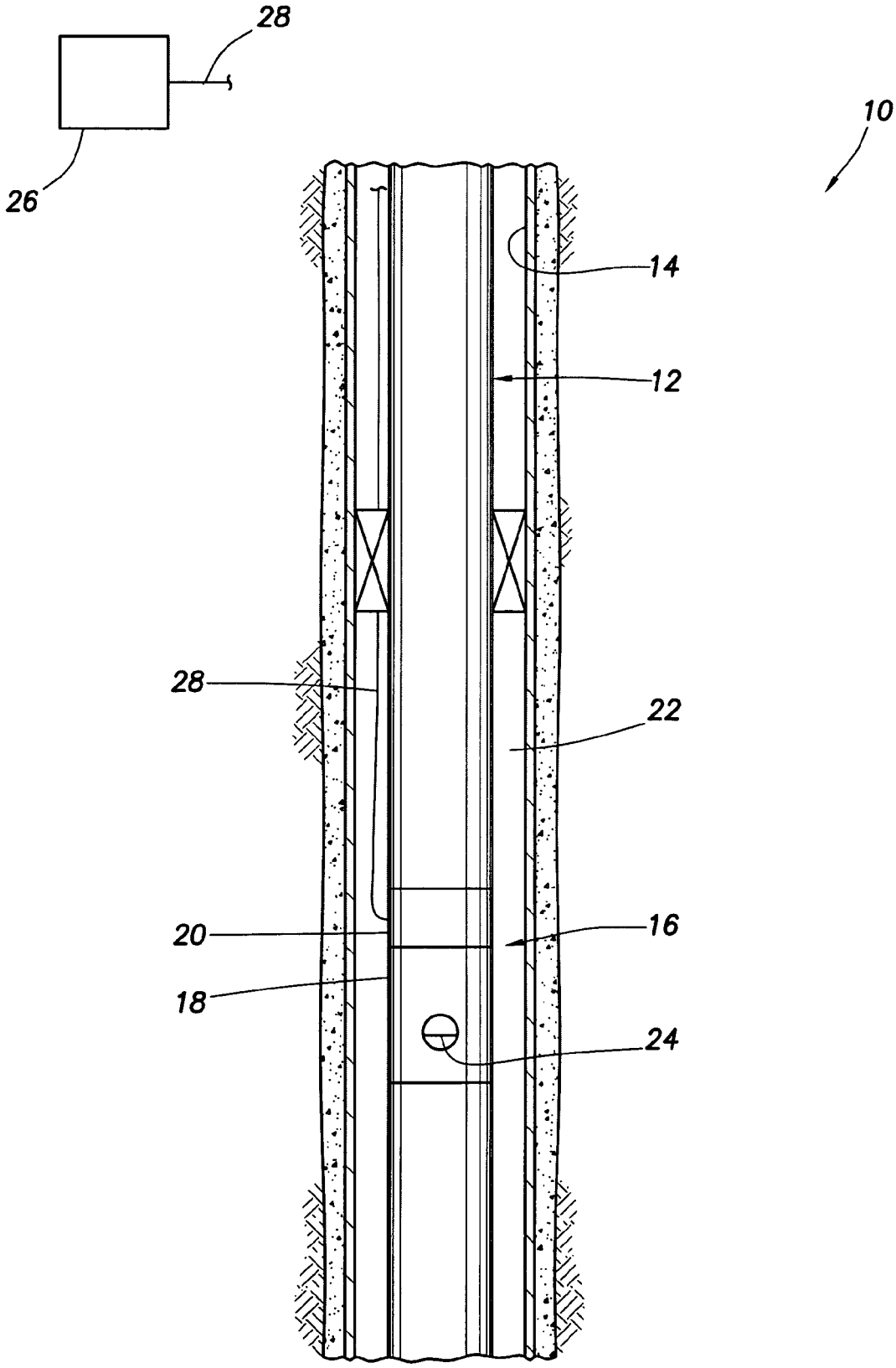
FIG. 1 is a schematic partially cross-sectional view of a well control system embodying principles of the present invention.

Representatively illustrated in FIG. 1 is a well control system 10 which embodies principles of the present invention. In the following description of the system 10 and other apparatus and methods described herein, directional terms, such as "above", "below", "upper", "lower", etc., are used for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

As depicted in FIG. 1, a tubular string 12 (such as a production, injection, drill, service, coiled tubing, or other type of tubular string) has been installed in a wellbore 14. A well tool 16 is interconnected in the tubular string 12. The well tool 16 includes a flow control device 18 and an actuator 20 for operating the flow control device.

For example, the flow control device 18 could be a valve or choke for controlling flow between an interior of the tubular string and an annulus 22 formed between the tubular string 12 and the wellbore 14. The actuator 20 could operate to displace a closure member 24 of the flow control device 18 to thereby regulate flow through the flow control device. However, it should be clearly understood that the well tool 16 may be any type of well tool, and does not necessarily include a flow control device, in keeping with the principles of the invention.

The actuator 20 is in fluid communication with a remote control system 26 via one or more fluid lines 28 extending therebetween. Fluid pressure applied to the lines 28 causes the actuator 20 to displace the closure member 24 to increase and/or decrease flow through the flow control device 18. For example, elevated or reduced pressure applied to one of the lines 28 may cause the actuator 20 to displace the closure member 24 in one direction, and elevated or reduced pressure applied to another of the lines may cause the actuator to displace the closure member in an opposite direction.

Other methods of controlling operation of the actuator 20 may be used in keeping with the principles of the invention.

Figure 2:
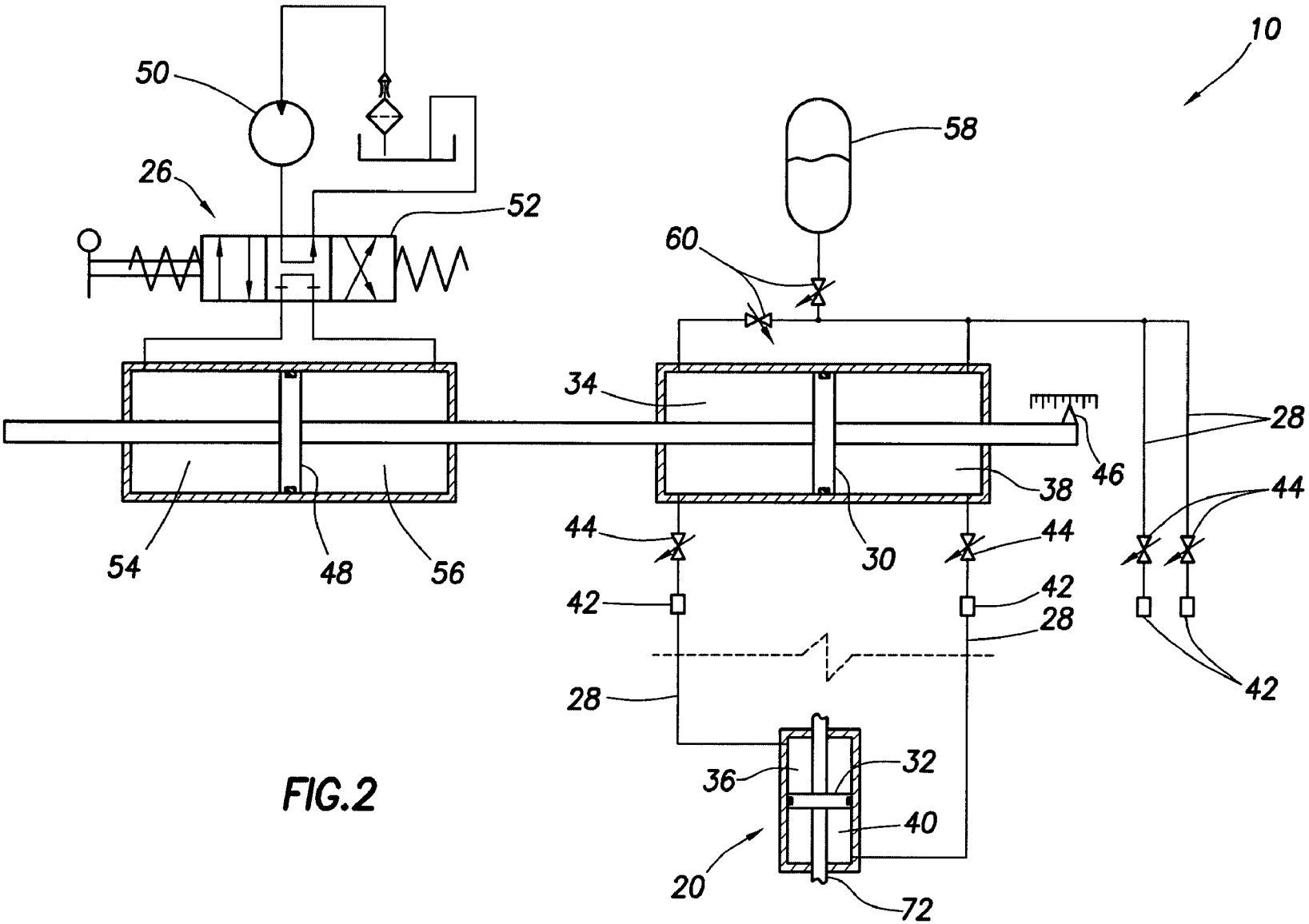
FIG. 2 is a schematic hydraulic circuit diagram of a first configuration of the system of FIG. 1.

Referring additionally now to FIG. 2, a schematic hydraulic circuit diagram is illustrated for the system 10. In this diagram it may be seen that a piston 30 of the remote control system 26 is in fluid communication with a piston 32 of the actuator 20. The piston 30 separates two chambers 34, 38, and the piston 32 separates two chambers 36, 40.

In this example, one of the lines 28 connects the chamber 34 to the chamber 36, and another one of the lines connects the chamber 38 to the chamber 40. The lines 28 may be connected using quick disconnects 42 at the surface. Valves 44 may be used to isolate the remote control system 26 from the actuator 20 when desired, such as when the actuator is not being operated. Additional lines 28, quick disconnects 42 and valves 44 may be provided for controlling operation of additional well tools.

It will be readily appreciated by those skilled in the art that when the piston 30 is displaced to the right as viewed in FIG. 2, fluid will be discharged from the chamber 38 and into the chamber 40 via one of the lines 28. This will cause the piston 32 to displace upward as viewed in FIG. 2, thereby discharging fluid from the chamber 36 and into the chamber 34 via another one of the lines 28. Similarly, displacement of the piston 30 to the left will cause the actuator piston 32 to displace downward as viewed in FIG. 2. The actuator piston 32 could, for example, be connected to the closure member 24 of the flow control device 18 via a member 72, so that such displacement of the piston may be used to displace the closure member.

It will also be appreciated that the pistons 30, 32 and their respective chambers 34, 36, 38, 40 are each part of a two-way balanced fluid cylinder as depicted in FIG. 2. That is, the piston 30 and its associated chambers 34, 38 are part of a two-way balanced fluid cylinder of the remote control system 26, and the piston 32 and its associated chambers 36, 40 are part of a two-way balanced fluid cylinder of the actuator 20.

The volume of fluid discharged due to displacement of the piston 30 is the same as the volume of fluid which causes displacement of the actuator piston 32. Therefore, the displacements of the pistons 30, 32 are directly proportional. The ratio of the piston 30 displacement to the piston 32 displacement is equal to the ratio of the piston 32 area to the piston 30 area. However, other configurations may be used in keeping with the principles of the invention, for example, using a pressure intensifier between the pistons 30, 32 could change the displacement ratio, etc.

Thus, in the configuration as depicted in FIG. 2, the position of the actuator piston 32 may be known if the position of the surface piston 30 is known, since the displacements of the pistons are directly proportional. To enable the position of the surface piston 30 to be known, an indicator member 46 is attached to the piston. As illustrated in FIG. 2, the member 46 is a pointer visible to an operator at the surface, a position of the pointer relative to a graduated scale indicating the position of the surface piston 30. However, any other type of indicating member may be used in keeping with the principles of the invention.

To displace the surface piston 30, the remote control system 26 includes another piston 48 connected to the surface piston 30. The piston 30 displaces with the piston 48. The piston 48 is displaced by means of a pressure source 50 (such as a pump, etc.) and a manually operated shuttle valve 52, which controls application of pressure from the pressure source to a selected one of two chambers 54, 56 separated by the piston 48.

When elevated pressure is applied to the chamber 54, the pistons 48, 30 will displace to the right, causing the actuator piston 32 to displace upward. When elevated pressure is applied to the other chamber 56, the pistons 48, 30 will displace to the left, causing the actuator piston 32 to displace downward.

Since the fluid in the lines 28 and chambers 34, 36, 38, 40 will be at least somewhat compressible, it is desirable to be able to compress the fluid prior to displacing the piston 30. In this manner, displacement of the piston 30 will not cause significant further compression of the fluid, and so displacement of the piston 30 at the surface will more accurately reflect the displacement of the piston 32 downhole.

To initially compress the fluid in the lines 28 and chambers 34, 36 prior to displacing the piston 30, the system includes a pressurizer 58 at the surface. The pressurizer 58 could be an accumulator charged with nitrogen gas, or a pump, or another type of pressure source.

The pressurizer 58 is connected to the chambers 34, 38 (and, thus, to the lines 28 and chambers 36, 40) via valves 60. Prior to displacing the piston 30, the valves 44, 60 are opened, thereby allowing the fluid in the lines 28 and chambers 34, 36, 38, 40 to be compressed to an elevated pressure by the pressurizer 58. Once the fluid is at the elevated pressure, the valves 60 are closed, and then the piston 30 is displaced to cause displacement of the actuator piston 32.

Of course, the member 46 displaces with the piston 30. Thus, a measurement of the displacement of the member 46 will permit the displacement of the piston 32 to be known. Alternatively, or in addition, a position of the member 46 may be related to a position of the piston 32 using other types of measurement, such as percentage of full stroke in each direction, etc.

One possibility is to displace the piston 30 in one direction until it is known that the piston 32 has fully stroked upward or downward, and then mark the resulting position of the member 46 (the piston 30 may or may not be fully stroked at the same time the piston 32 is fully stroked). The piston 30 is then displaced in the opposite direction until it is known that the piston has fully stroked in its corresponding upward or downward direction, and the position of the member 46 is marked again. The two marks now indicate the fully stroked positions of the piston 32, and the piston 32 can now be displaced to a known position between its fully stroked positions by displacing the surface piston 30 so that the member 46 is at the corresponding position between the two marks.

Figure 3:
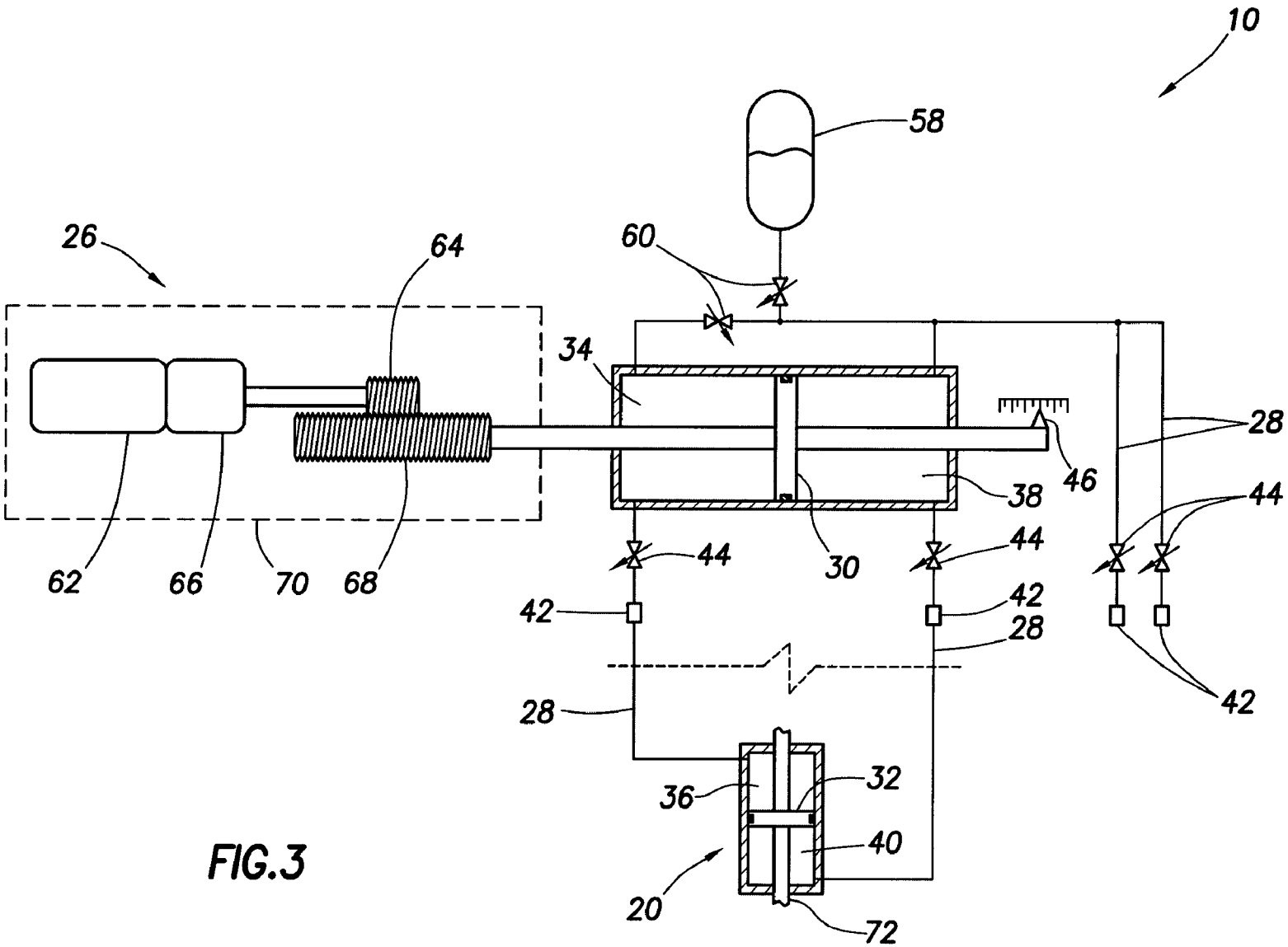
FIG. 3 is a schematic hydraulic circuit diagram of a second configuration of the system of FIG. 1.

Referring additionally now to FIG. 3, another configuration of the system 10 is depicted in which the piston 48, pump 50 and shuttle valve 52 are not used to displace the piston 30 at the surface. Instead, the piston 30 is displaced by means of a motor 62 which rotates a threaded shaft 64 via a gear reducer 66. Rotation of the shaft 64 causes displacement of a threaded spindle 68 which is connected to the piston 30.

The motor 62, gear reducer 66, shaft 64 and spindle 68 may be included in a commercially available displacement device 70, or they may be purpose-built and assembled for a particular application. This configuration of the system 10 demonstrates that any type of displacement device may be used to displace the piston 30.

Note that it is not necessary in keeping with the principles of the invention for the control system 26 to be positioned at the earth's surface in any of the embodiments of the system 10 described herein. For example, the control system 26 could be positioned at any location remote from the actuator 20, such as at another downhole location, at a mudline, at a subsea wellhead, on a subsea pipeline, etc. The principles of the invention are also not limited to placement of the actuator 20 in a downhole environment, since the actuator could instead be used to control actuation of, for example, subsea chokes, subsea gas lift equipment, drill stem testing equipment, emergency disconnect systems, surface and subsea pipeline equipment, etc.

It will be readily appreciated by those skilled in the art that the system 10 provides a closed-loop fluid circuit between the pistons 30, 32 of the remote control system 26 and the actuator 20. That is, when the pistons 30, 32 are displacing, there is no loss or gain of fluid in the chambers 34, 36, 38, 40 and lines 28 interconnecting the chambers. Thus, both sides of each of the pistons 30, 32 are closed to fluid losses and gains, so that conservation of energy and mass are maintained between the two remote pistons, thereby making their displacements directly proportional.

This is not the case in typical open-loop hydraulic control systems, in which fluid is delivered to one side of a piston by a pump, and fluid is discharged from the other side of the piston to a reservoir, usually at atmospheric pressure. One disadvantage of such open-loop hydraulic control systems is that gas entrained in the fluid at low pressures (e.g., at atmospheric pressure) causes non-linear changes in volume as the pressure is increased (e.g., by use of a pump).

One benefit of using a closed-loop fluid control system, such as the system 10, is that friction during displacement of the actuator piston 32 is compensated for. Initial displacement of the remote control system piston 30 causes a pressure differential across the actuator piston 32, which in turn causes the actuator piston to displace. If friction prevents some portion of displacement of the actuator piston 32, this will result in a residual pressure differential remaining across the actuator piston (i.e., due to conservation of work in the closed-loop hydraulic circuit). This residual pressure differential will be communicated to the remote control system piston 30, which will in response displace to a position which more accurately indicates the position of the actuator piston 32.

Note that it is also not necessary in keeping with the principles of the invention for the member 46 to be visible to an operator. For example, equipment and instrumentation (such as sensors and telemetry, etc.) may be used to communicate indications of the position of the piston 30 to an operator at a remote location, or to other facilities (such as to data storage devices or automated well control systems, etc.).

Although the system 10 has been described above as utilizing a closed-loop fluid circuit, it should be clearly understood that such a circuit is not limited to a hydraulic circuit. Other types of fluids can be used. For example, the system 10 could utilize a closed-loop pneumatic circuit.

It will also be appreciated that the conservation of energy principles utilized in the system 10 may also be used in conjunction with other types of closed-loop circuits. For example, an electrical circuit could be used in which the lines 28 are electrical lines and the pistons 30, 32 and cylinders 34, 36, 38, 40 are replaced by electrical solenoids (i.e., the actuator 20 would include one solenoid, and the remote control system 26 would include another solenoid). In that case, displacement of one solenoid member would cause electrical current to be transmitted via the lines 28 to another remotely positioned solenoid, thereby causing displacement of a member of the remote solenoid.

Figure 4:
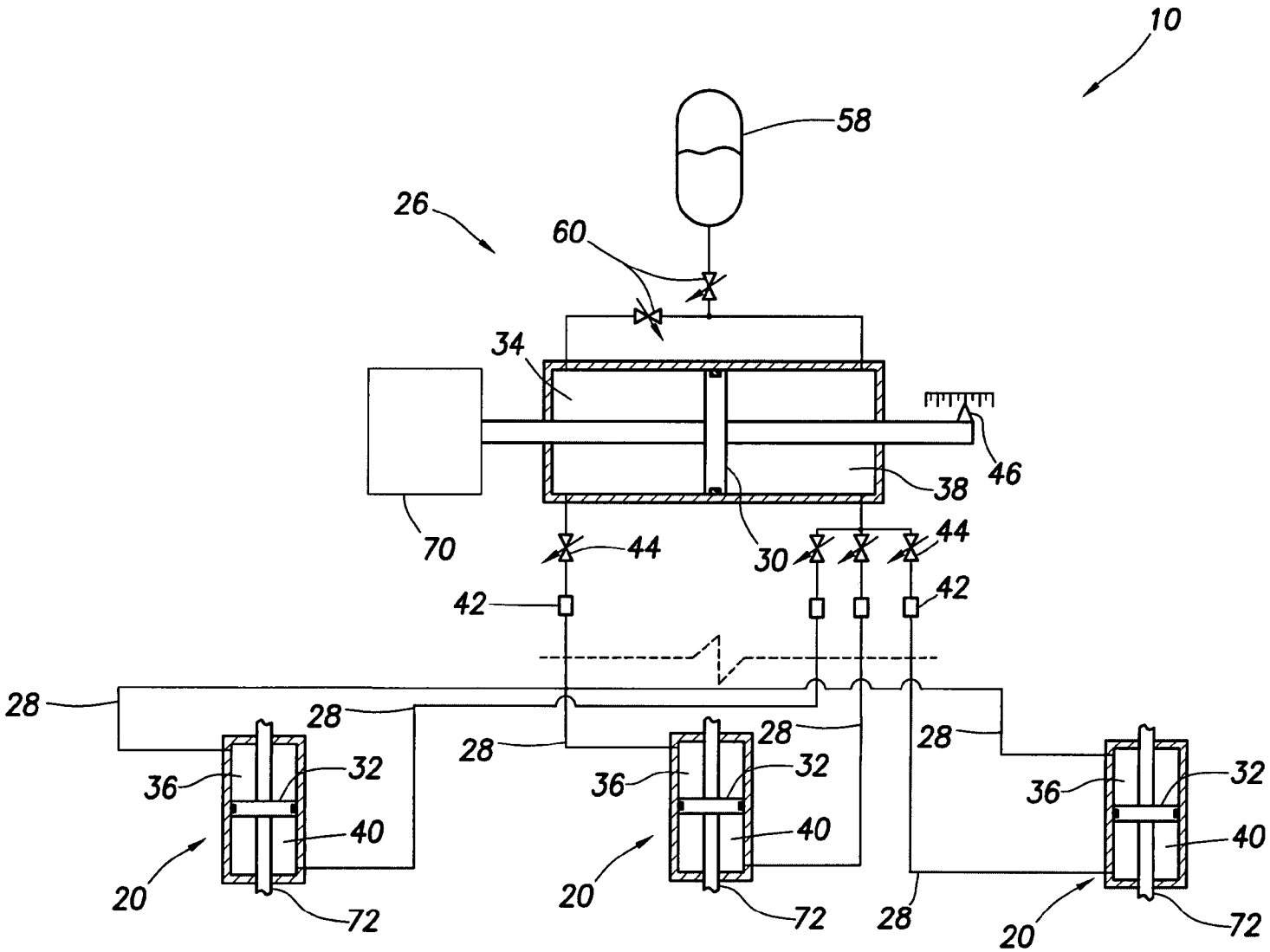
FIG. 4 is a schematic hydraulic circuit diagram of a third configuration of the system of FIG. 1.

Representatively illustrated in FIG. 4 is another configuration of the system 10, in which multiple actuators 20 are connected to the remote control system 26. Note that one side of each one of the chambers 36 of the actuators 20 is connected to the same chamber 34 of the remote control system 26, but the chamber 38 of the remote control system is connected to selected ones of the chambers 40 of the actuators (via multiple valves 44 interconnected between the chamber 38 and the chambers 40). In this manner, each of the actuators 20 may be operated individually, or multiple ones of the actuators may be operated simultaneously.

Of course, a person skilled in the art would, upon a careful consideration of the above description of representative embodiments of the invention, readily appreciate that many modifications, additions, substitutions, deletions, and other changes may be made to the specific embodiments, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. A system f or controlling operation of a tool, the system comprising:

an actuator for the tool, the actuator including an actuator member which displaces with a piston of the actuator to operate the tool, the actuator piston separating first and second chambers of the actuator;

a control system member disposed at a location remote from the actuator, a displacement of the control system member with a control system piston causing a displacement of the actuator member, the control system member displacement being proportional to the actuator member displacement, and the control system piston separating first and second chambers of a control system at the remote location, and the control system piston being exposed to pressure in each of the first and second control system chambers; and a first line providing communication between the control system first chamber and the actuator first chamber, and a second line simultaneously providing communication between the control system second chamber and the actuator second chamber.

2. The system of claim 1, wherein the actuator and control system pistons are included in a closed-loop fluid circuit.

3. The system of claim 2, wherein each of the actuator and control system pistons is included in a two-way balanced fluid cylinder.

4. The system of claim 2, wherein conservation of energy and mass are maintained during displacements of the actuator and control system pistons.

5. The system of claim 1, wherein fluid is neither added to nor removed from any of the first and second lines, the first and second chambers of the actuator and the first and second chambers of the control system during displacement of the actuator and control system pistons.

6. The system of claim 1, wherein the tool is at least one of a well tool, a choke, a subsea tool and a pipeline tool.

7. The system of claim 1, wherein the remote location is one of a surface location, a mudline location, a subsea location and a downhole location.

8. The system of claim 1, wherein the actuator and control system members are included in a closed-loop electrical circuit.

9. The system of claim 1, wherein the system includes multiple actuators for operating multiple corresponding tools, and wherein displacement of the control system member causes proportional displacement of the actuator member of a selected at least one of the actuators.

10. A well control system, comprising:

an actuator for a downhole well tool, the actuator including an actuator member which displaces to operate the well tool;

a control system member disposed at a location remote from the actuator, a displacement of the control system member being proportional to a displacement of the actuator member; and at least two fluid lines connected between the actuator and the control system at the remote location, fluid flowing from the control system at the remote location to the actuator through a first one of the lines and fluid simultaneously flowing from the actuator to the control system at the remote location through a second one of the lines when the control system piston and actuator piston displace, and wherein the remote location is a surface location, and wherein the control system member is visible to an operator of the control system at the surface location.

11. The system of claim 10, wherein the control system member is attached to a piston of the control system at the remote location.

12. The system of claim 11, wherein the actuator member is attached to a piston of the actuator.

13. The system of claim 12, wherein the displacement of the control system piston causes a transfer of fluid between a chamber of the control system at the remote location and a chamber of the actuator, thereby causing the displacement of the actuator piston.

14. The system of claim 12, wherein the control system piston separates first and second chambers of the control system at the remote location, wherein the actuator piston separates first and second chambers of the actuator, and wherein the first line provides communication between the control system first chamber and the actuator first chamber, and the second line provides communication between the control system second chamber and the actuator second chamber.

15. The system of claim 14, further comprising a pressurizer which applies elevated pressure simultaneously to the control system first and second chambers, the actuator first and second chambers, and the first and second lines prior to the displacements of the control system piston and the actuator piston.

16. The system of claim 10, further comprising a piston at the remote location, the control system member displacing in response to displacement of the piston.

17. The system of claim 10, further comprising a motor at the remote location, the control system member displacing in response to operation of the motor.

18. A method of controlling actuation of a downhole well tool, the method comprising the steps of:

displacing a control system member;

displacing an actuator member of an actuator for the well tool in response to the control system member displacing step, a displacement of the actuator member being proportional to a displacement of the control system member;

attaching the control system member to a piston of the control system at a surface location;

attaching the actuator member to a piston of the actuator;

flowing fluid from the control system at the surface location to the actuator through a first fluid line;

flowing fluid from the actuator to the control system at the surface location through a second fluid line; and viewing displacement of the control system member at the surface location by an operator during the control system member displacing step.

19. The method of claim 18, further comprising the step of providing fluid communication between the actuator and the control system at the surface location during the displacing steps.

20. The method of claim 18, further comprising the step of transferring fluid between a chamber of the control system at the surface location and a chamber of the actuator, thereby causing the displacement of the actuator piston, in response to displacement of the control system piston.

21. A method of controlling actuation of a downhole well tool, the method comprising the steps of:

displacing a control system member;

displacing an actuator member of an actuator for the well tool in response to the control system member displacing step, a displacement of the actuator member being proportional to a displacement of the control system member;

attaching the control system member to a piston of the control system at the surface location;

attaching the actuator member to a piston of the actuator; and viewing displacement of the control system member at a surface location by an operator during the control system member displacing step, and wherein the control system piston separates first and second chambers of the control system at the remote location, wherein the actuator piston separates first and second chambers of the actuator, and further comprising a first line providing communication between the control system first chamber and the actuator first chamber, and a second line providing communication between the control system second chamber and the actuator second chamber.

22. The method of claim 21, further comprising the step of applying elevated pressure simultaneously to the control system first and second chambers, the actuator first and second chambers, and the first and second lines prior to the displacements of the control system piston and the actuator piston.

23. The method of claim 18, further comprising the step of displacing a piston at the surface location, and wherein the control system member displacing step is performed in response to the piston displacing step.

24. A method of controlling actuation of a downhole well tool, the method comprising the steps of:

displacing a control system member;

displacing an actuator member of an actuator for the well tool in response to the control system member displacing step, a displacement of the actuator member being proportional to a displacement of the control system member;

viewing displacement of the control system member at a surface location by an operator during the control system member displacing step; and operating a motor at the surface location, and wherein the control system member displacing step is performed in response to the motor operating step.

* * * * *

UNITED STATES PATENT AND TRADEMARK OFFICE

CERTIFICATE OF CORRECTION

PATENT NO. : 7,240,737 B2
APPLICATION NO. : 11/403039
DATED : July 10, 2007
INVENTOR(S) : Timothy R. Tips It is certified that error appears in the above-identified patent and that said Letters Patent is hereby corrected as shown below:

In column 6, line 13
delete "f or"
add in place thereof --for--

Signed and Sealed this

Twenty-second Day of September, 2009

David J. Kappos

David J. Kappos
*Director of the United States Patent and Trademark Office*